United States Patent [19]

Delaney

[11] 4,163,484

[45] Aug. 7, 1979

[54] COMBINATION LUGGAGE PROTECTOR AND SPOTTER

[76] Inventor: John H. Delaney, 146-25 20th Rd., Whitestone, N.Y. 11357

[21] Appl. No.: 897,563

[22] Filed: Apr. 18, 1978

[51] Int. Cl.[2] ..... A45C 13/36

[52] U.S. Cl. ..... 190/18 R; 190/37; 190/60

[58] Field of Search ..... 190/37, 18 R, 54, 60, 190/41 R; 206/586

[56] References Cited

U.S. PATENT DOCUMENTS

| | | | |
|---|---|---|---|
| 1,908,671 | 5/1933 | Hossfeld | 190/37 UX |
| 2,272,584 | 2/1942 | Ritter | 190/37 |
| 2,610,715 | 9/1952 | Plotkin | 190/37 |
| 2,847,100 | 8/1958 | Hotchner | 190/37 X |
| 2,848,079 | 8/1958 | Brodie | 190/54 |
| 3,041,775 | 7/1962 | Brown | 206/586 X |
| 3,417,496 | 12/1968 | Von Meyer | 190/60 |

*Primary Examiner*—Donald F. Norton

[57] ABSTRACT

A member having a flat base and a raised resilient body adapted to be manufactured and produced in many colors and designs, including means for quick adhesive attachment of a flat base portion thereof to luggage along edges or around corners which may be subjected to rough usage, the member serving in the dual capacity of protector and as a means for permitting the owner to identify his luggage quickly.

5 Claims, 3 Drawing Figures

COMBINATION LUGGAGE PROTECTOR AND SPOTTER

BACKGROUND OF THE INVENTION

The present invention has particular application to luggage carried by air, particularly where such luggage is of lightweight construction and susceptible to damage during handling. The invention seeks to provide an inexpensive, quickly attachable means for protecting luggage of this type against moderate to severe impact forces and additionally finds utility in serving as a means for distinguishing and identifying an individual piece of luggage.

It is known to provide rigid bumper devices permanently affixed for example, to the base or lower part of luggage which act to support a piece of luggage while standing. U.S. Pat. No. 2,272,584 and U.S. Pat. No. Re. 7,164 are representative. Furthermore, various kinds of identification devices have been proposed. For example, U.S. Pat. Nos. 2,847,100 and 3,417,496 are directed to devices or strips which may be attached to luggage adhesively to permit the luggage to be identified more easily when upon a baggage conveyor, etc. Although the prior art has concerned itself with base support devices and the described identification means, nevertheless, the concept of a separate resilient luggage protector and identification spotter which may be readily applied to luggage and removal therefrom has not been suggested. It is this need which the present invention is intended to fill.

SUMMARY OF THE INVENTION

More specifically, in accordance with the present invention, there is provided a luggage protector comprising a member having a flat base portion and a rounded body portion, said body portion being composed of a resiliently deformable material, said base portion having a layer of contact adhesive thereon and a peelable strip of material covering said adhesive such that upon removal of said peelable strip, said luggage protector may be affixed to an exterior surface of a piece of luggage to protect said luggage from impact. In a preferred embodiment, the protector body is covered by a flexible sheet of material, for example, vinyl plastic permitting the body to be deformed readily about curved surfaces, i.e. corners of a piece of luggage. The outer covering may be distinctively colored and designed to provide an individual means for identifying the luggage to which the protector is attached.

DESCRIPTION OF A PREFERRED EMBODIMENT

Figure 1:
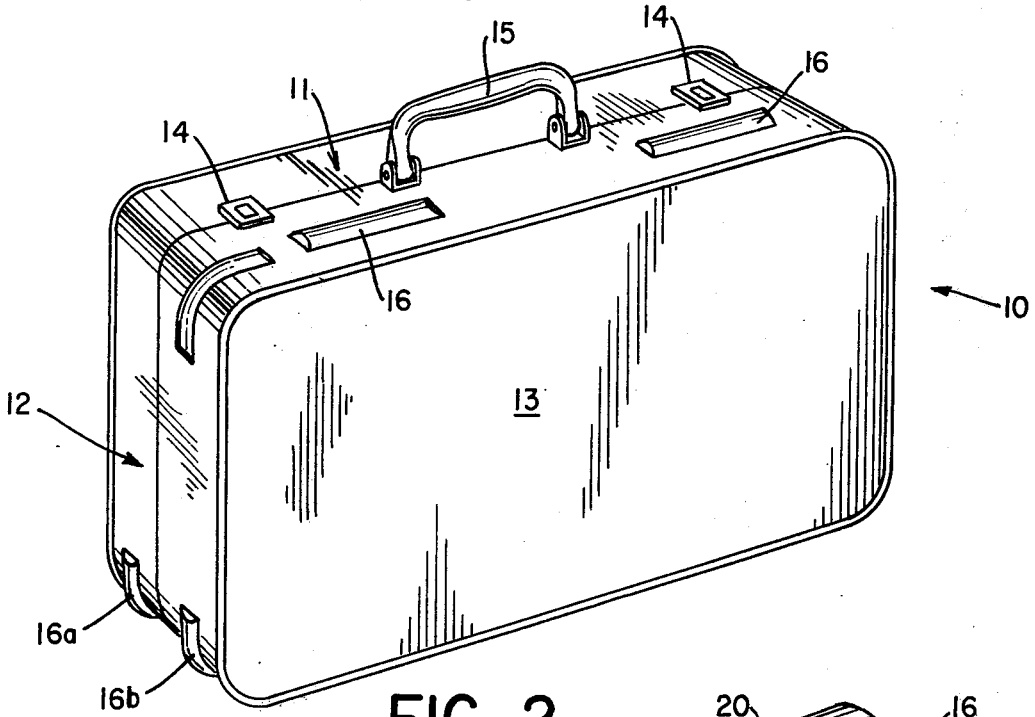
FIG. 1 is a perspective view of a lightweight in-flight luggage to which the combination luggage protector and spotter of the present invention has been attached.

Referring now to the drawing and initially to FIG. 1 thereof, a unit of in-flight luggage 10 has been illustrated. The unit 10 will typically consist of top 11, ends 12, and a bottom integrally connected and sides 13 made of fabric. The top, ends, sides and bottom are constructed as mating halves hinged to permit access to the interior with fasteners 14 securing the bag in its closed position. Handle 15 is provided for carrying.

It will be understood that typically such in-flight luggage relies on its structural integrity upon the stiffness or rigidity of the top, ends and bottom sections, which are generally of molded, one-piece construction and may or may not be internally reinforced by a wire frame. However, a sharp blow addressed to any part of these members, particularly at the corners where very little flexibility exists, will cause a crushing of the bag. Since such luggage is frequently handled very roughly in the course of loading and unloading, a device which would protect such luggage against impact would considerably extend its life.

Figure 2:
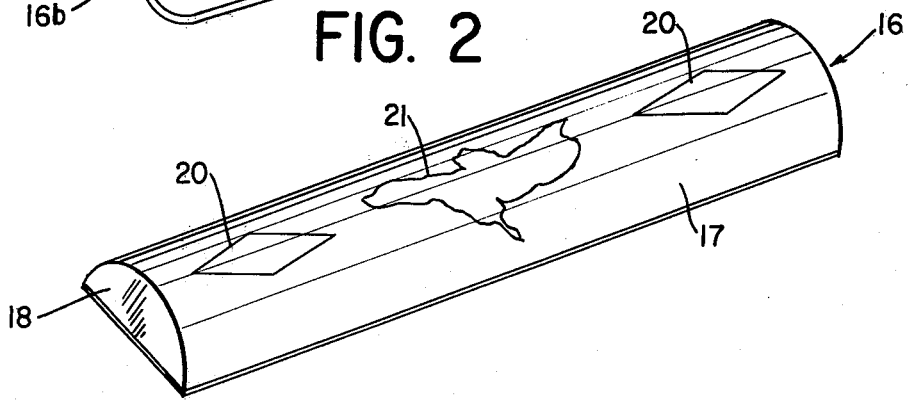
FIG. 2 is an enlarged detail of one form of the luggage protector and spotter according to the present invention.

In accordance with the present invention, a combination luggage protector 16 and spotter may be readily attached to any flat, rigid surface of a piece of luggage in order to protect luggage against impact and provide an individualized means of identification. Referring to FIG. 2, one form which the protector may assume has been illustrated. In this form, the protector has been molded as a half round piece having an outer covering 17 which may be vinyl plastic for example bonded to a foam rubber core 18.

Figure 3:
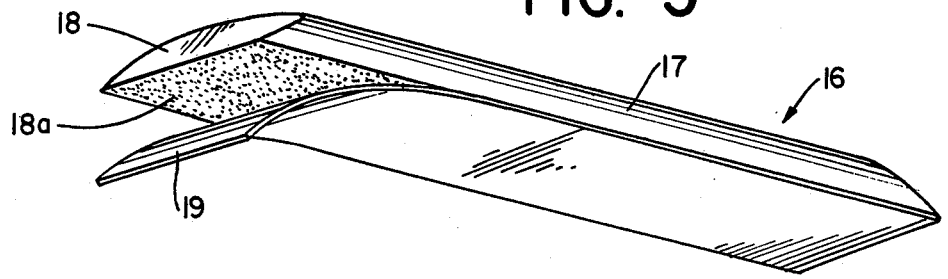
FIG. 3 is a view of the luggage protector and spotter of FIG. 2 preparatory to rendering it adhesively connectable to a piece of luggage.

Referring to FIG. 3, the bottom surface **18*a* of the foam rubber core will be coated with a contact-type adhesive, and this surface will be kept covered with a paper peel-off strip 19 until the protector 16** is thereby fastened to a piece of luggage.

When the strip has been peeled off, the protector 16 may be quickly attached to flat, fairly rigid surfaces of the luggage, which for illustrative purposes in FIG. 1, is the top 11 of the luggage 10. Additionally, the adhesive will be of the non-permanent setting type so that a protector 16 can be stripped fairly easily from the luggage if later desired.

It will be seen that various designs 20, 21 can be printed onto the outer vinyl plastic covering, and of course the covering can be made in different colors or designs to signify the identifying colors of different airlines. It is obvious that the protector can also be made in shapes other than that illustrated so long as the body of the protector includes a resilient core such as foam rubber or other resilient material, and the protector has sufficient height or thickness to take blows which otherwise would be directed upon the surface of the luggage to which it is attached. It will be observed with respect to FIG. 1 that the protector is readily deformable about the corners of the luggage, especially where the thickness of the luggage construction prevents much flexibility. Protectors **16*a* and 16*b*** (with matching protectors similarly situated at the opposite end [not shown] of the luggage) can in effect serve as base supports for a piece of luggage to cushion the shock of dropping the luggage on hard surfaces.

Although the protector has primary utility as a means for protecting luggage, the fact that various designs may be imprinted or placed thereon and the arrangement of the device on the luggage itself may be varied provides individuality and permits a device to serve as a means of spotting an individual's luggage and quickly identifying it among many other pieces of luggage.

It will be understood that the foregoing description has been of a particular embodiment of the present invention and is therefore merely representative. In order to understand the scope of the invention, reference should be made to the appended claims.

I claim:

1. In combination with a luggage case of generally oblong shape having top, bottom, end and side walls meeting generally perpendicular to each other, a combination protector and spotter comprising a member having an elongated flat base portion and a rounded body portion of distinctive color, said body portion being composed of a resiliently deformable material, said base portion having a layer of contact adhesive thereon and a peelable strip of material covering said adhesive such that upon removal of said peelable strip, said luggage protector may be variably affixed to any part of one of said walls of said luggage case to protect said case from impact and to provide a source of identification of said case.

2. The combination according to claim 1 wherein said luggage case includes curved surfaces, said protector is elongated and deformable when positioned about said curved surfaces of said luggage case to minimize impact thereon.

3. The combination according to claim 2 wherein said curved surfaces connect the bottom and end walls of said luggage case permitting said luggage case to be supported upon said protector when said luggage case stands in an upright position.

4. The combination according to claim 2 wherein the body portion of said protector and spotter is covered by a flexible sheet material.

5. The combination according to claim 4 wherein said flexible sheet of material is distinctively colored and designed to provide means for identifying the luggage case to which the protector is attached.

* * * * *